US011174142B2

(12) United States Patent
Boscaro et al.

(10) Patent No.: US 11,174,142 B2
(45) Date of Patent: Nov. 16, 2021

(54) MOTION TRANSMISSION GROUP FOR CAPPING HEADS FOR SCREW CAPS AND CAPPING MACHINE EQUIPPED WITH SUCH A MOTION TRANSMISSION GROUP

(71) Applicant: MBF S.p.A., Verona (IT)

(72) Inventors: Giuliano Boscaro, Verona (IT); Alessandro Ticinelli, Verona (IT); Andrea Stella, Verona (IT)

(73) Assignee: MBF S.p.A.

( * ) Notice: Subject to any disclaimer, the term of this patent is extended or adjusted under 35 U.S.C. 154(b) by 162 days.

(21) Appl. No.: 16/667,877

(22) Filed: Oct. 29, 2019

(65) Prior Publication Data

US 2020/0131014 A1 Apr. 30, 2020

(30) Foreign Application Priority Data

Oct. 31, 2018 (IT) ..... 102018000009973

(51) Int. Cl.
*B67B 3/20* (2006.01)

(52) U.S. Cl.
CPC ..... *B67B 3/2066* (2013.01); *B67B 3/2013* (2013.01); *B67B 2201/10* (2013.01)

(58) Field of Classification Search
CPC ..... B67B 3/2013; B67B 3/2066; B67B 3/10; B67B 3/2033; B67B 3/20; B67B 3/12; B67B 2201/10
See application file for complete search history.

(56) References Cited

U.S. PATENT DOCUMENTS 5,884,450 A * 3/1999 Ronchi ..... B67B 3/00 53/317
6,170,232 B1 * 1/2001 VandeGeijn ..... B23B 31/113 279/4.09
6,216,340 B1 * 4/2001 Fassbind ..... B67B 7/182 29/773
6,543,204 B2 * 4/2003 Gruson ..... B67B 3/2066 279/93
6,840,024 B2 * 1/2005 Ronchi ..... B67B 3/00 53/317

(Continued)

FOREIGN PATENT DOCUMENTS

EP 1273551 8/2003
EP 1864941 12/2007

OTHER PUBLICATIONS

Italian Search Report, dated Jul. 4, 2019.

*Primary Examiner* — Thomas M Wittenschlaeger
(74) *Attorney, Agent, or Firm* — Valauskas Corder LLC

(57) ABSTRACT

The present invention concerns a motion transmission group for capping heads for screw caps. This group comprises a device for applying in use a predefined axial load to means of axial engagement of the caps which a capping head associated in use with said group is provided with. The device comprises at least one axially pre-loaded compression spring so as to generate in use this predefined axial load. The device is separable from the main structure of the transmission group as a single body, with the aforesaid at least one spring maintained associated with a support structure of the device in pre-loaded condition by means of two axial positioning portions to allow the replacement of the device with a structurally similar device, but suitable to generate in use a different axial load.

19 Claims, 13 Drawing Sheets

(56) References Cited

U.S. PATENT DOCUMENTS

| | | | | |
|---|---|---|---|---|
| 7,661,245 | B2 * | 2/2010 | Brown | B67B 3/2066 53/317 |
| 10,787,353 | B2 * | 9/2020 | Schoenfelder | B67B 3/2066 |
| 2002/0184853 | A1 * | 12/2002 | Arrant | B65B 7/2835 53/343 |
| 2004/0065049 | A1 * | 4/2004 | Cirio | B67B 3/2086 53/317 |
| 2012/0055115 | A1 * | 3/2012 | Preti | B67B 3/22 53/342 |
| 2018/0354765 | A1 * | 12/2018 | Schoenfelder | B67B 3/2066 |
| 2020/0048061 | A1 * | 2/2020 | Caffa | B67B 3/2093 |
| 2020/0087129 | A1 * | 3/2020 | Caffa | H02K 7/06 |

* cited by examiner

MOTION TRANSMISSION GROUP FOR CAPPING HEADS FOR SCREW CAPS AND CAPPING MACHINE EQUIPPED WITH SUCH A MOTION TRANSMISSION GROUP

CROSS-REFERENCE TO RELATED APPLICATIONS

The present invention claims priority to Italian Patent Application No. 102018000009973 filed on Oct. 31, 2018.

SCOPE

The present invention concerns a motion transmission group for capping heads for screw caps and a capping machine equipped with such a motion transmission group.

In particular, the motion transmission group for capping heads for screw caps according to the invention is intended to operate with capping heads suitable to apply ROPP (Roll on Pilfer Proof) screw caps and/or pre-threaded caps.

The transmission group according to the invention may be used both in single capping machines and in multiple capping machines, of the rotary type.

STATE OF THE ART

There are different types of screw caps. In particular, the following are known:

- the so-called ROPP (Roll on Pilfer Proof) caps in which the screw thread is obtained by deforming the cap onto the threaded neck of the bottle; and
- pre-threaded caps, which are already threaded and must be screwed onto the threaded neck of the bottle to be capped.

In both cases, during the capping operation, the cap is deformed below the threaded portion at an annular ridge on the neck of the bottle to obtain an anchoring/sealing ring on the cap. The sealing ring is connected to the upper threaded portion of the cap by means of a pre-weakened connection area, which is broken when the cap is opened by applying an appropriate moment of rotation to the upper threaded portion. If the connection area is intact, the ridge and the sealing ring lock the cap in the axial position. The integrity of the connection between the sealing ring and the upper part of the cap is thus a sign of the integrity of the closure.

The screw caps described above are applied automatically using special capping heads.

In the case of ROPP caps, the capping heads are also threading heads, as they must be able to deform the cap to obtain the screw thread; in the case of pre-threaded caps, the capping heads are also screwing heads, as they must be able to screw the pre-threaded portion of the cap onto the threaded neck of the bottle. In both cases, the capping heads must be able to deform the cap to make the aforesaid sealing ring.

The capping heads are actuated by special capping machines, which may be of two types:

- single capping machines, i.e., machines that are equipped with a single capping head and may operate on one bottle at a time; or
- multiple capping machines, i.e. machines that are equipped with multiple capping heads and may operate on more than one bottle at a time.

Typically, multiple capping machines are rotary machines, equipped with a rotating support turret, which moves a plurality of capping heads, mounted on the periphery of the turret, following a circular path along which the bottles to be capped are conveyed.

These rotary machines receive the bottles from a conveyor belt. The caps may already be positioned on the neck of the bottles in a station upstream of the capping machine or be positioned on the bottles directly at the entrance of the same capping machine. The bottles are taken from the conveyor belt and placed on a rotating support, which transports them along the circular path around the main axis of the turret.

During this circular movement, the capping machine drives the capping heads (threaders/screwers) in such a way that, during the revolution around the main axis of the turret, a capping head is present above each bottle.

Operationally, during the rotation imposed by the turret, the capping heads are driven in vertical translation to reach the mouth of the container to be capped and then rise once capping is completed, to be free to continue in the production cycle. During the rotation imposed by the turret, the capping heads are also rotated around their own axes, so as to rotate in turn relative to the bottles. This relative rotation movement between bottle and head (coordinated with the translation movement) functional for obtaining the threading in the case of ROPP caps or the screwing in the case of pre-threaded caps; and in both cases, is functional for obtaining the sealing ring.

Each capping head is associated with the capping machine by means of a motion transmission group, which is suitable to transfer to the capping head the rotation motion around its own axis and the translation motion along this axis. Generally, the connection between the motion transmission group and the capping head is obtained by means of a quick coupling/release system.

As is known, both in the case of ROPP caps and in the case of pre-threaded caps, the capping operation must be carried out in such a way that the top portion of each cap is brought into abutment with the mouth of the bottle and a predefined axial load is applied to the cap.

Generally, the axial load is applied by means of one or more pre-loaded compression springs, which are activated during the vertical translation movement of the head. These compression springs may be integrated into the motion transmission groups or may be integrated directly into the capping heads.

As is known, this axial load varies according to the type of cap and is established by the manufacturer of the cap to ensure the tightness of the closure. Thus, if the type of cap to be applied to the bottles is changed, it is also necessary to vary the axial load that the capping machine applies to the cap itself once it is brought into abutment with the mouth of the bottle.

As is known, this situation occurs frequently. In effect, it is common in the bottling sector for production requirements to require frequent changes to the cap used, thus rendering interventions on the capping machines necessary.

This operational situation has led to a strong need for flexible capping machines, which may quickly adapt to different types of caps, while continuing to ensure the correctness of the final result in terms of the tightness of the capping.

To date, this need for flexibility has not been fully satisfied.

The limits of operational flexibility are mainly related to the need to apply to each type of cap the specific axial load required by the manufacturer to ensure the tightness of the closure, and not so much to the execution of the operations of threading/screwing/sealing. In effect, in addition to the fact that, as already mentioned, the capping heads are easily replaceable, in many cases different caps have the same requirements in terms of execution of the R threading/screwing/sealing operations and may therefore be applied by a same capping head. Normally, however, each cap requires the application of a specific axial load, different from that of other caps. Therefore, even if it is possible to use the same capping head, every time the cap is changed, the adjustment of the axial load is in fact unavoidable.

In the case wherein the axial load is applied by means of a spring integrated into the motion transmission group, the axial load adjustment proves to be operationally complex and long. The pre-loaded spring must in effect be removed from the transmission group and replaced with another one, which must then be suitably pre-loaded in a calibrated manner. During disassembly, it is necessary to unload the pre-loaded spring in a controlled way until reaches a state of rest so that it may be extracted safely; during assembly, the new spring must be progressively loaded and then locked in position once the desired pre-load has been obtained. Taking into account the high forces involved and the delicate nature of the operation, this change must be carried out by specialized personnel using appropriate equipment. The intervention times are very long with prolonged machine stops. This situation is acceptable only for productions that do not require frequent cap changes.

The plant solution that provides for the integration of the axial load spring in the transmission group has the advantage of allowing the use of capping heads without the devices for applying the axial load. This makes the capping heads simpler and less expensive.

Generally, in order to increase the operational flexibility of this technical solution, the motion transmission groups are equipped with two different coaxial compression springs, able to apply different axial loads, as in the solution of the prior art shown in FIGS. 1 and 2, where the two springs are indicated at M1 and M2, while the motion transmission group at GT. In this way, the operating range of the system is extended, reducing the frequency of changing the spring. FIG. 2 indicates at P the axial engagement means of the caps which are integrated into the capping head T and in use cooperate with the springs M1 and M2.

If, on the other hand, the axial load is applied by means of devices integrated into the capping heads, there is maximum operational flexibility. It is in effect possible to provide a dedicated capping head for each type of cap. Considering that the capping heads are designed to be quickly associable with the motion transmission group of the capping machines, the replacement of the heads is an easy and quick operation.

The limit of this solution is the high cost of the system linked both to the need to provide for a set of capping heads for each type of cap and to the higher cost of the heads themselves. This limit is partially reduced if the same capping head may be used for different types of caps. In this case, however, the change speed is lost, since it would still prove necessary to calibrate the capping head according to the axial load required by the specific type of cap.

In light of the above, there is still a great need to increase the operational flexibility of a capping machine operating with capping heads for screw caps, which combines speed in operational adaptation to cap changes, reduced system costs and operational reliability.

PRESENTATION OF THE INVENTION

Therefore, the main object of the present invention is to eliminate all or part of the drawbacks of the aforementioned prior art, by providing a motion transmission group for capping heads for screw caps that is equipped with an integrated axial load device and allows a fast and reliable adjustment of the axial load, without requiring the intervention of specialized personnel.

A further object of the present invention is to provide a motion transmission group for capping heads for screw caps that is simple and economical to produce further object of the present invention is to provide a motion transmission group for capping heads for screw caps that is simple and economical to operate.

BRIEF DESCRIPTION OF THE DRAWINGS

The technical features of the invention, according to the aforesaid objects, are clearly apparent from the contents of toe claims provided below and the advantages thereof will become more apparent in the following detailed description, made with reference to the accompanying drawings, which represent one or more purely illustrative and non-limiting embodiments thereof, wherein:

DETAILED DESCRIPTION

The present invention concerns a motion transmission group for capping heads for screw caps and a capping machine equipped with this motion transmission group.

The motion transmission group for capping heads for screw caps will be indicated collectively at 1 in the accompanying Figures, while the capping machine will be indicated collectively at number 100.

Here and in the description provided hereinafter and in the claims, the motion transmission group 1 and the capping machine 100 will be referred to in condition of use. It is in this sense that any references to a lower or upper position, or to a horizontal or vertical orientation, are therefore to be understood.

The transmission group 1 according to the invention is intended to be operationally associated with capping heads T equipped with means P for axially engaging the screw caps to be applied to the bottles or containers.

In particular, the motion transmission group 1 for capping heads for screw caps according to the invention is intended to operate with capping heads suitable to apply ROPP (Roll on Pilfer Proof) screw caps and/or pre-threaded caps.

The transmission group 1 is intended to be operationally associated with a capping machine 100, which may be a single capping machine, or a multiple capping machine, of the rotary type.

Figure 1:
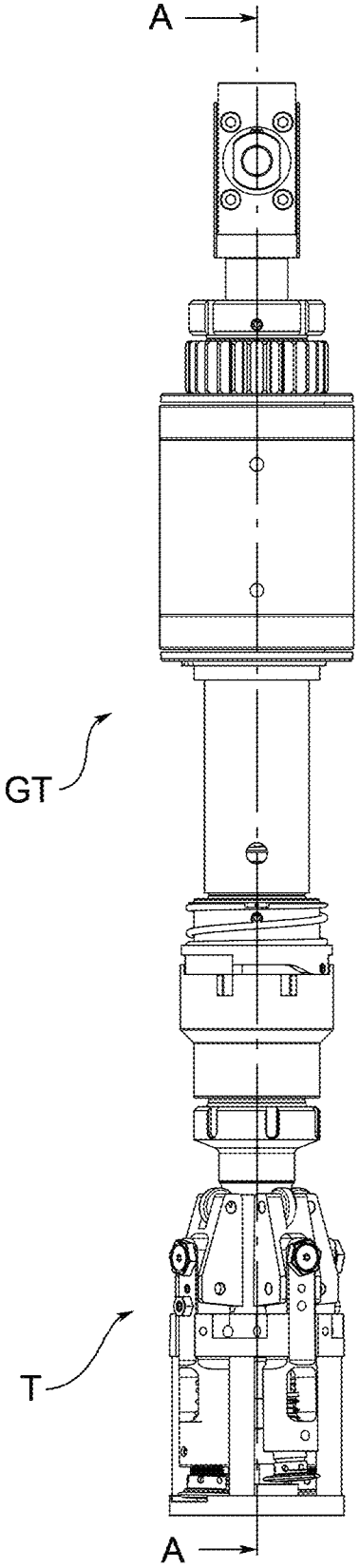
FIG. 1 shows an orthogonal view in elevation of a traditional motion transmission group with an associated capping head for screw caps.
Figure 2:
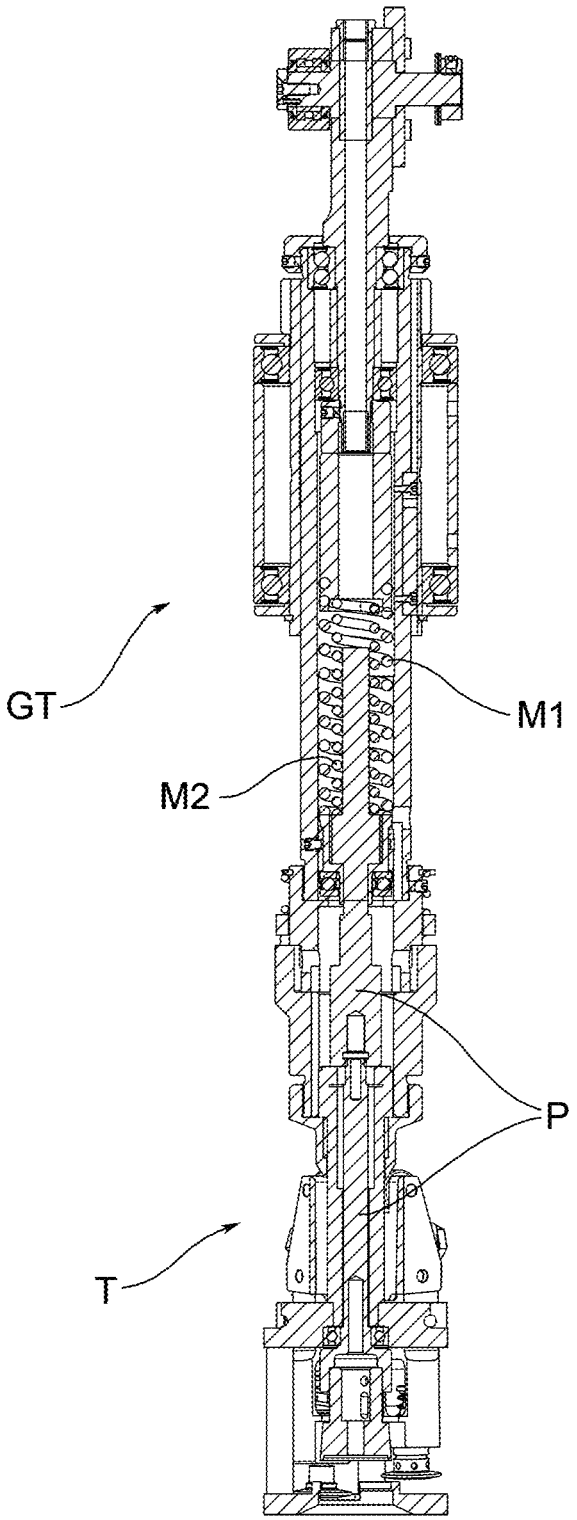
FIG. 2 shows a sectional view of the group in FIG. 1 according to the sectional plane A-A shown therein.
Figure 3:
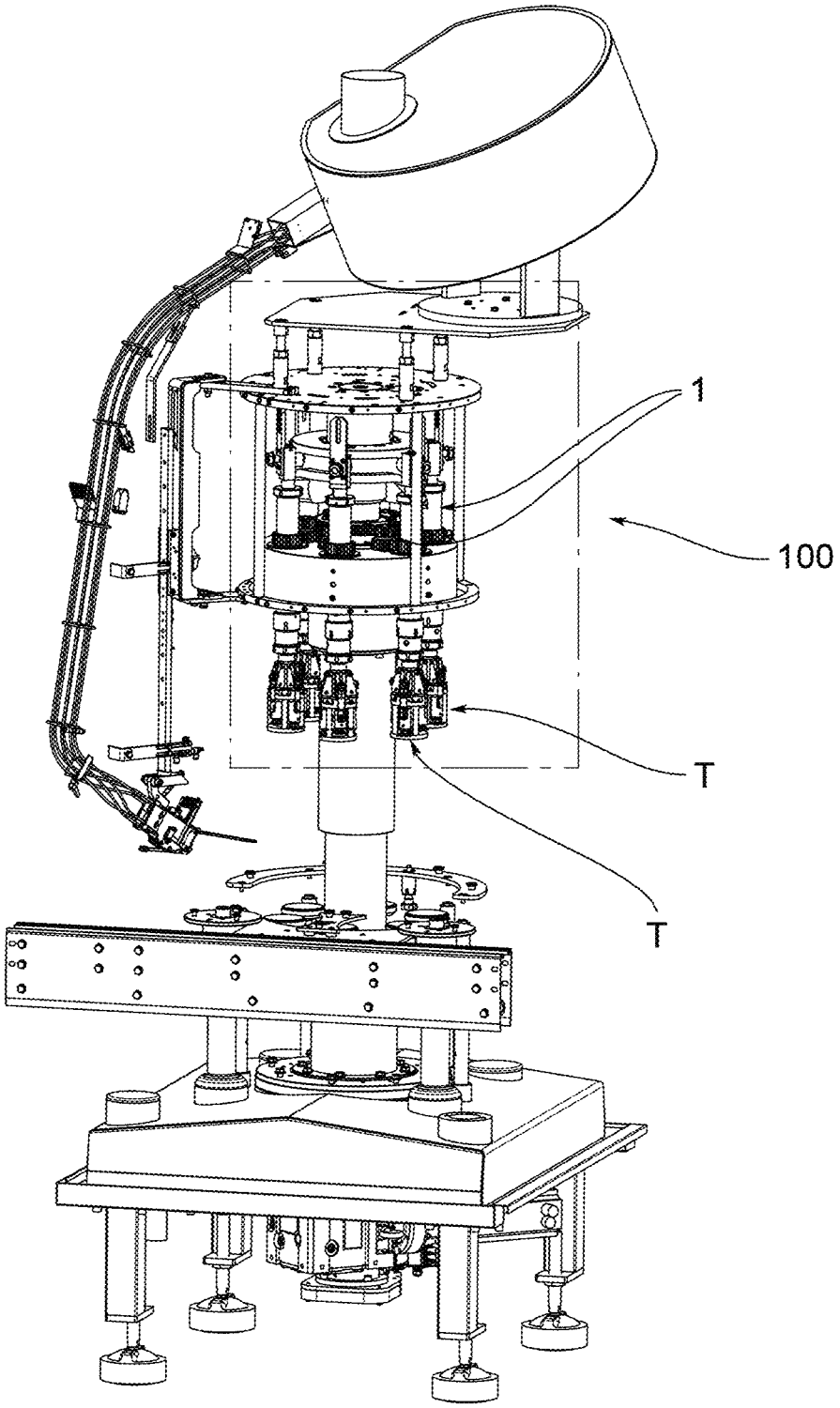
FIG. 3 shows a perspective view of a multiple capping machine equipped with motion transmission groups according to a preferred embodiment of the invention.
Figure 4:
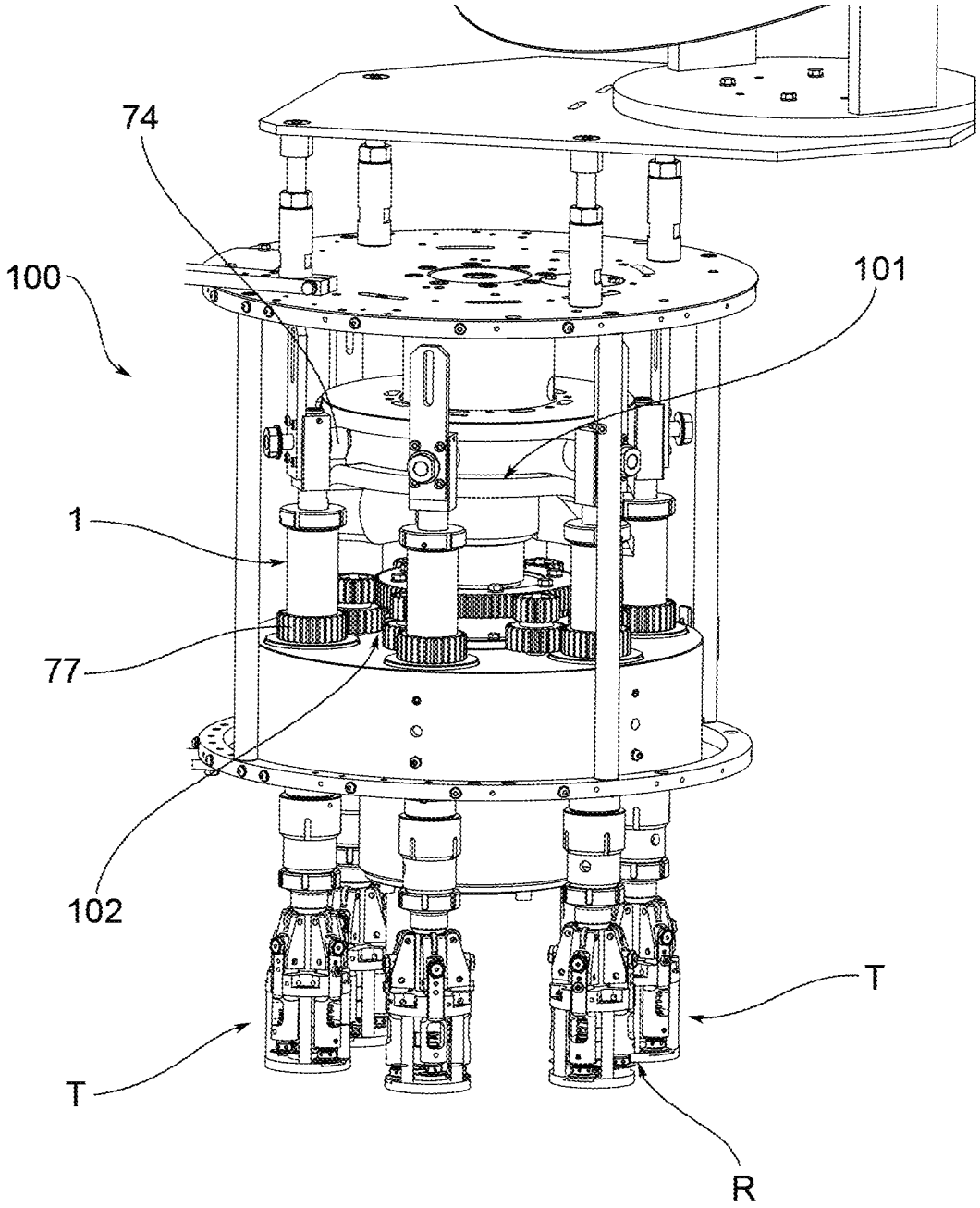
FIG. 4 shows an enlarged detail of the machine in FIG. 3, relative to the rotating turret.
Figure 5:
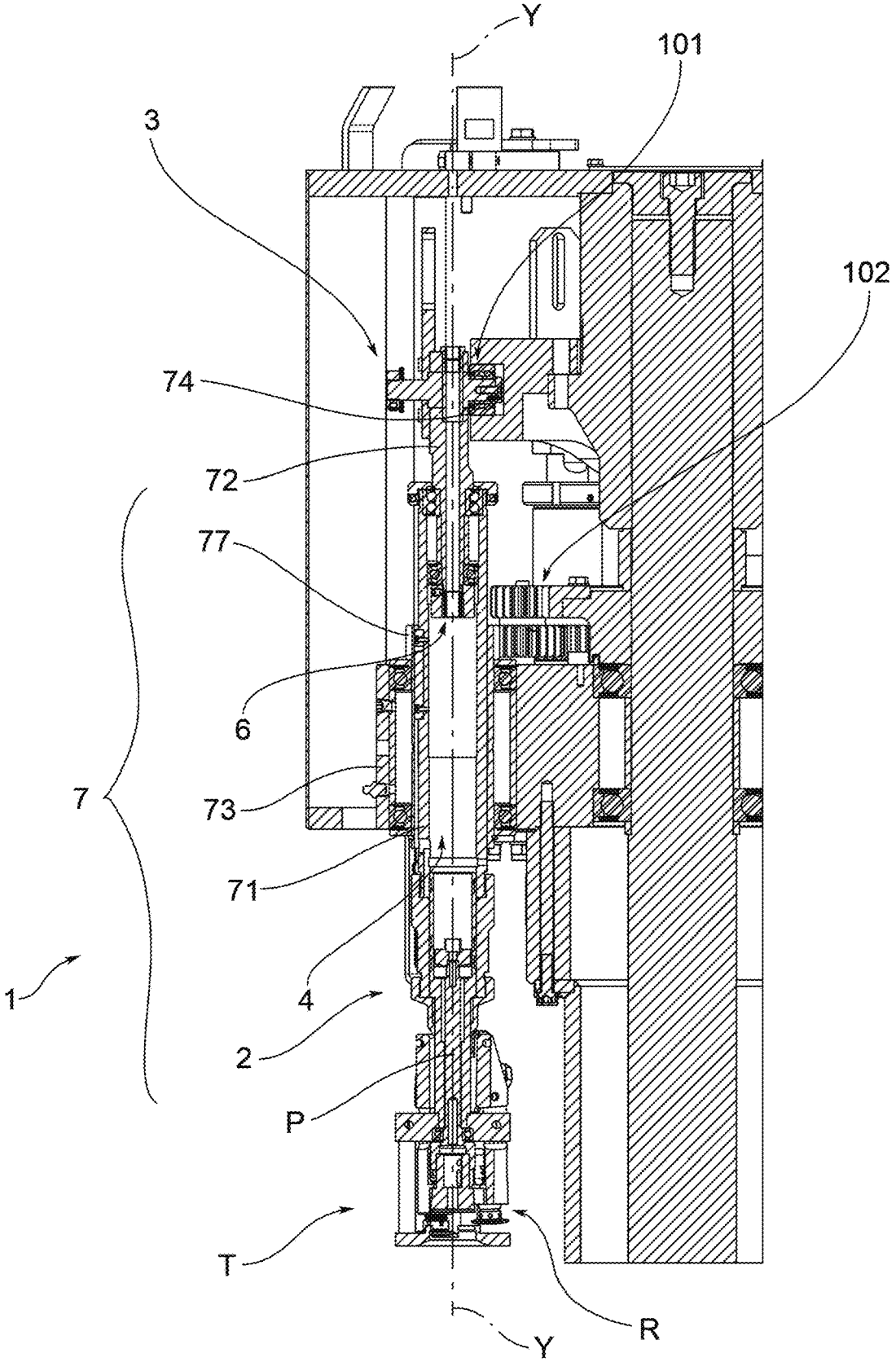
FIG. 5 shows a radial sectional view of a portion of the turret of FIG. 4 relative to a motion transmission group with an associated capping head, the transmission group being illustrated with some parts removed to better highlight other parts thereof.
Figure 6:
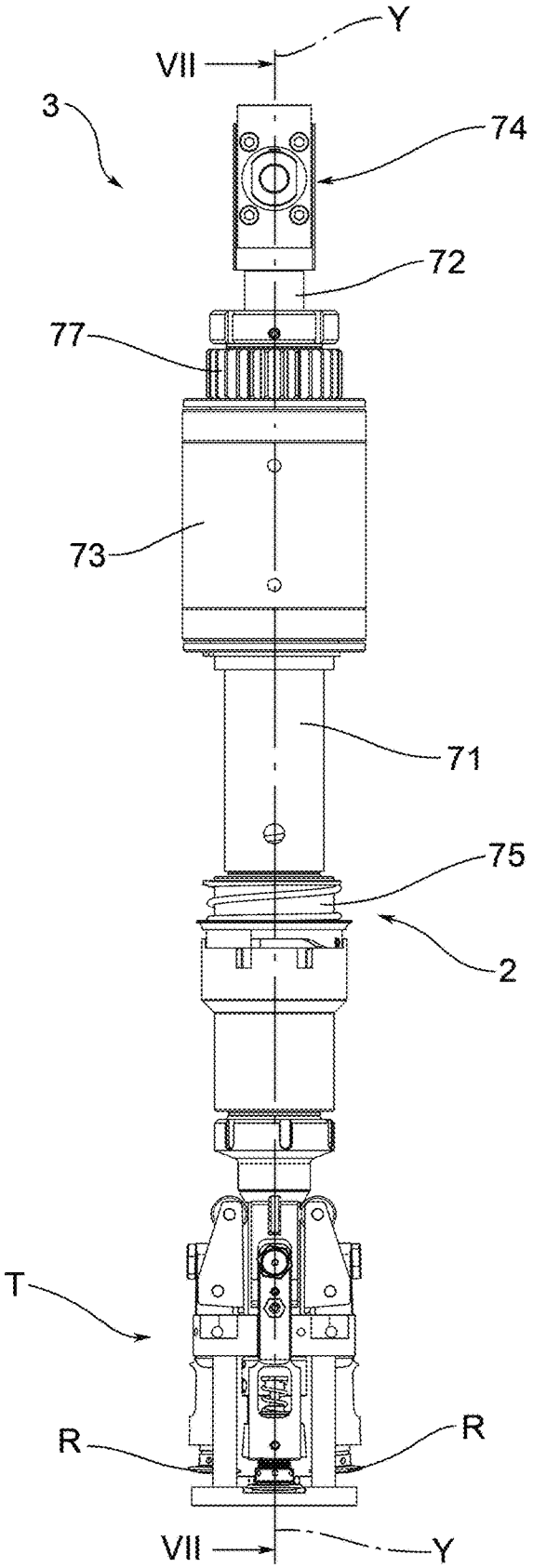
FIG. 6 shows an orthogonal view in elevation of a motion transmission group according to a preferred embodiment of the invention, illustrated with an associated capping head for screw caps.

An example of a multiple capping machine provided with one or more transmission groups 1 according to the invention is shown in FIGS. 3, 4 and 5.

Figure 15:
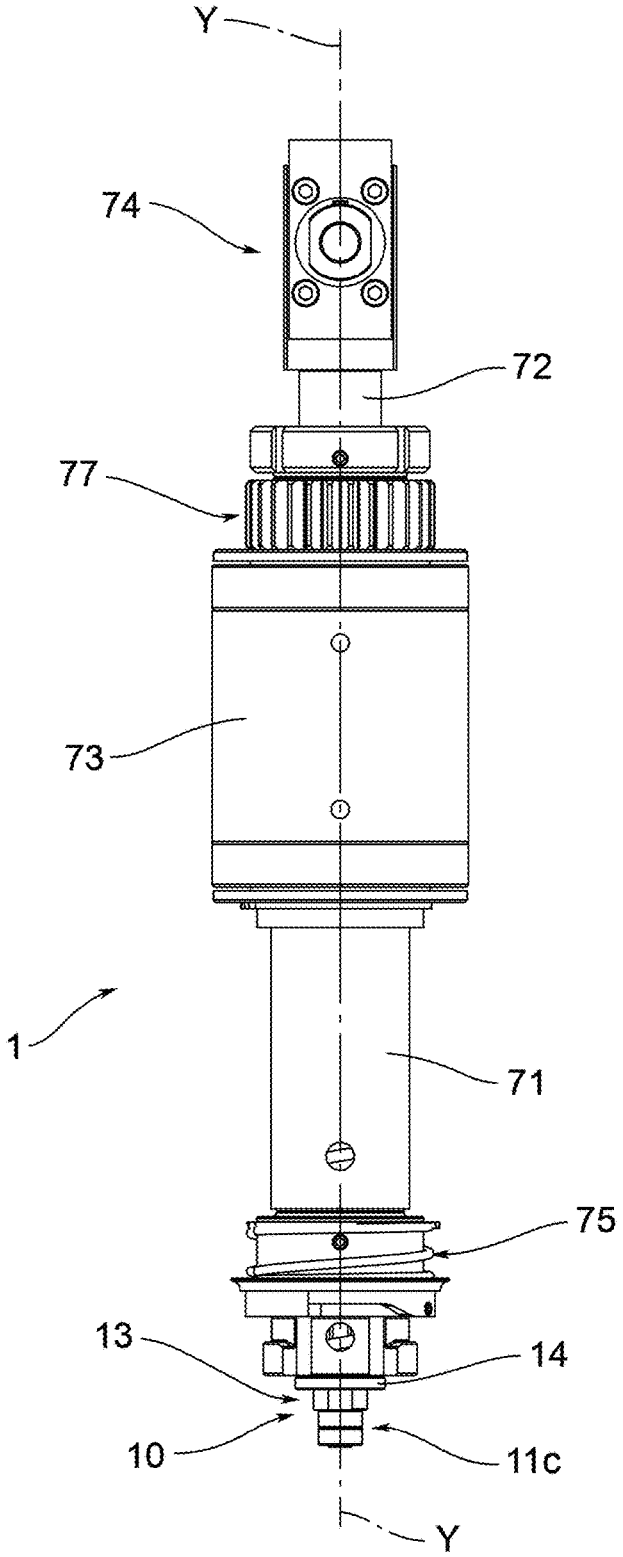
FIG. 15 shows an orthogonal view in elevation of the motion transmission group in FIG. 6 according to the invention, illustrated without the associated capping head.
Figure 14:
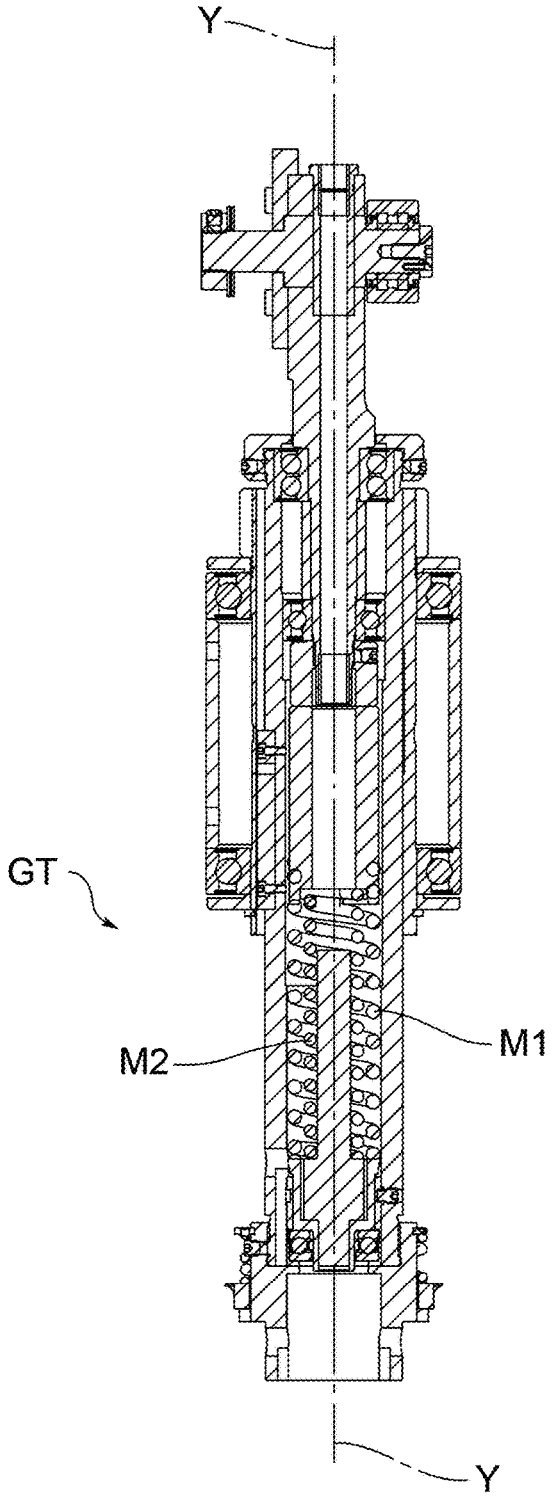
FIG. 14 shows an axial sectional view of the transmission group illustrated in FIG. 13.
Figure 16:
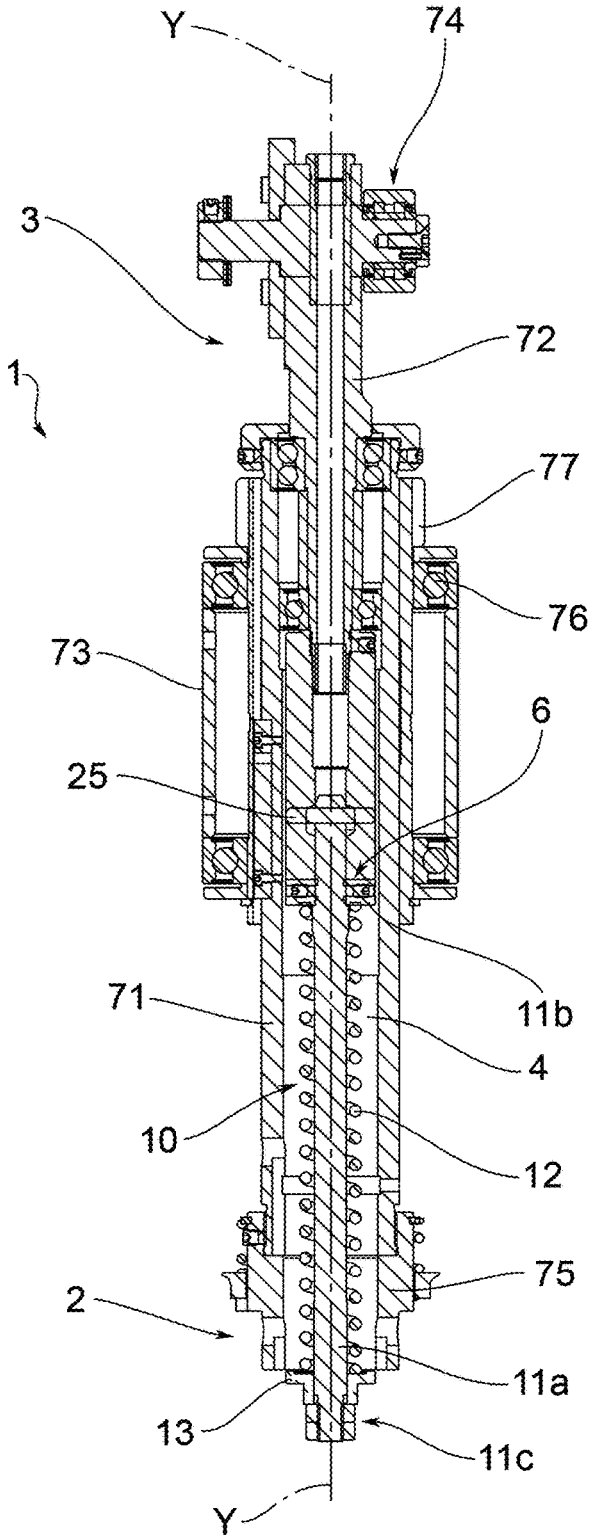
FIG. 16 shows an axis sectional view of the transmission group in FIG. 15.

As illustrated in particular in FIGS. 6 to 9 and in FIGS. 15 and 16, the transmission group 1 comprises a main structure 7 that extends along a longitudinal axis Y between a coupling end 2 for a capping head T and a drive end 3, axially opposite to the coupling end 2, at which the group 1 is configured to receive in input from a capping machine 100 translation movements along the aforesaid axis and rotation movements around this axis Y to be transmitted in use to the capping head T.

The structural and functional features of a capping head T for screw caps that is operationally associable with the transmission group 1 according to the invention are well known per se to a person skilled in the art and will therefore not be described here in detail.

Here one is limited to recalling that in general these capping heads T comprise at least:

- means P for axially engaging the screw caps to be applied to bottles or containers;
- means R for circumferentially engaging the screw caps, in order to screw them onto the threaded portion of the neck of the bottle (in the case of pre-threaded caps) or deform them onto the threaded portion of the neck of the bottle to create the thread.

In the preferred case of application of ROPP caps or pre-threaded caps for beading, these capping heads T comprise means for circumferentially engaging the screw caps, in order to deform them on the neck of the bottle to create the sealing ring.

The transmission group 1 comprises a device 10 for applying in use a predefined axial load to the aforesaid means of axial engagement P of the caps, which a capping head T associated in use with the coupling end 2 of the group 1 is provided with.

In turn this device 10 comprises at least one axially pre-loaded compression spring 12 so as to generate in use the aforesaid predefined axial load.

According to one aspect of the invention, the device 10 comprises a support structure 11 for the aforesaid at least one compression spring 12.

This support structure 11 is suitable to hold the compression spring 12 coaxially arranged on the axis Y in a predefined pre-load condition by means of a first axial positioning portion 11*b* and a second axial positioning portion 11*c*, which are associated with a main body 11*a* of this support structure 11 in axially different positions.

The aforesaid support structure 11 for the compression spring is shaped in such a way that at least one compression spring 12 is engageable directly or indirectly from the outside of the support structure 11 to allow in use the operational coupling with the means of axial engagement P of the caps, which a capping head T associated in use with the coupling end 2 is provided with.

According to a further aspect of the invention, the aforesaid device 10 is separable from the main structure 7 of the transmission group 1 as a single body, with the aforesaid at least one spring 12 maintained associated, with the main body 11*a* of the support structure 11 of the device in pre-loaded condition by means of the aforesaid two axial positioning portions 11*b*, 11*c* to allow the replacement of this device 10 with a structurally similar device, but suitable to generate in use a different axial load.

"Structurally similar device" means a device that is interchangeable with the device 10 but equipped with a different spring or the same spring but with a different pre-load.

Unlike traditional solutions of the known art, due to the transmission group 1 according to the invention, to change the axial load applied to the caps, the compression, spring of the axial load device may be replaced, without separating it from the other components of the same device, and therefore without requiring controlled unloading operations of the pre-load forces. The spring is in effect replaced together with the entire axial load device and replaced with another spring, already inserted and properly pre-loaded in another axial load device, interchangeable with the first.

This greatly simplifies the operations of replacing a spring, both during the disassembly of the spring to be replaced, and during the assembly of the new spring, avoiding the intervention of specialized personnel and the use of tools dedicated to the purpose.

According to the different screw caps to be applied, the user may in effect preventively obtain a set of axial load devices, each prepared in advance to generate in use a pre-defined axial load that is specific for a type of cap according to the manufacturer's instructions.

Due to the invention, a motion transmission group for capping heads for screw caps (with integrated axial load device) is thus made available, which allows axial loading to be adjusted quickly and reliably, without the need for specialized personnel.

The aforesaid device 10 is separably associable to the main structure 7 of the transmission group 1 by means of reversible connection means 5, 25.

Preferably, these reversible connection means 5, 25 are of the quick coupling/release type, e.g. bayonet or screw-on type.

Advantageously, the aforesaid axial load device 10 may be separably associated with the main structure 7 of the transmission group 1 at the first axial end 11' of the support structure 11, not engaged by the spring 12, by means of the aforesaid reversible connection means 5, 25.

Functionally, as illustrated in particular in FIG. 16, the support structure 11 of the device 10 is shaped in such a way that the aforesaid at least one compression spring 12 is engageable directly or indirectly from the outside of the support structure 11 at a second axial end 11" of the same structure 11, which is opposite to the first axial end 11' and in use is arranged near the coupling end 2 of the transmission group 1.

Preferably, as illustrated in detail in FIGS. 11*a-b*, 12*a-b*, 20 and 21, the axial load device 10 comprises a movable abutment body 13 which is slidingly associated axially with the support structure 11 and is interposed between one end of the spring 12 and the second axial positioning portion 11*c*. This second axial positioning portion 11*c* is located near the second axial end 11" of the support structure 11. The aforesaid movable abutment body 13 faces outwards from said support structure 11 near said second axial end 11". In use, the spring 12 is intended to exert the aforesaid predefined axial load on the axial engagement means P of the caps by means of this movable abutment body 13.

Advantageously, at least one of the aforesaid two axial positioning portions 11*b*, 11*c* is adjustable in axial position relative to the main body 11*a* of the support structure 11 to adjust the pre-load of the compression spring 12. In this way, the single axial load device 10 may be adapted to generate different axial loads, if necessary.

According to a first embodiment of the invention, illustrated in particular in FIGS. 6, 7, 8, 11*a-b* and 12*a-b*, the main body of the support structure 11 consists of a bar 11*a* that extends along the axis Y between the first axial end 11' and the second axial end 11" and supports coaxially the aforesaid at least one compression spring 12. The first axial positioning portion 11*b* and the second axial positioning portion 11*c* respectively consist of a first and a second fixed annular body, which are arranged in axially different positions along the bar to hold between them the aforesaid at least one spring 12 in pre-loaded condition.

The aforesaid movable abutment body consists of a movable annular body 13, which is slidingly associated with the bar and interposed between one end of the spring 12 and the second fixed annular body 11*c*. Preferably, this movable annular body defines an annular protrusion 14 protruding radially relative to the second fixed annular body 11*c*. Operationally, the movable annular body 13 engages in abutment the spring 12 at this annular protrusion 14 and is in turn engageable from the outside of the structure 11 at this annular protrusion 14.

In particular, as shown in FIGS. 6, 7, 8, 11*a-b* and 12*a-b*, the first axial positioning portion 11*b* consists of an annular flange, which may be fixed in the axial position on the bar 11*a* by radial coupling means, consisting for example of grub screws 30. The second axial positioning portion consists of one or two threaded nuts 31, tightened on a counter-threaded portion of the end of the bar 11*a*.

In particular, according to this first embodiment of the invention, the device 10 comprises a single axially pre-loaded compression spring 12.

Figure 20:
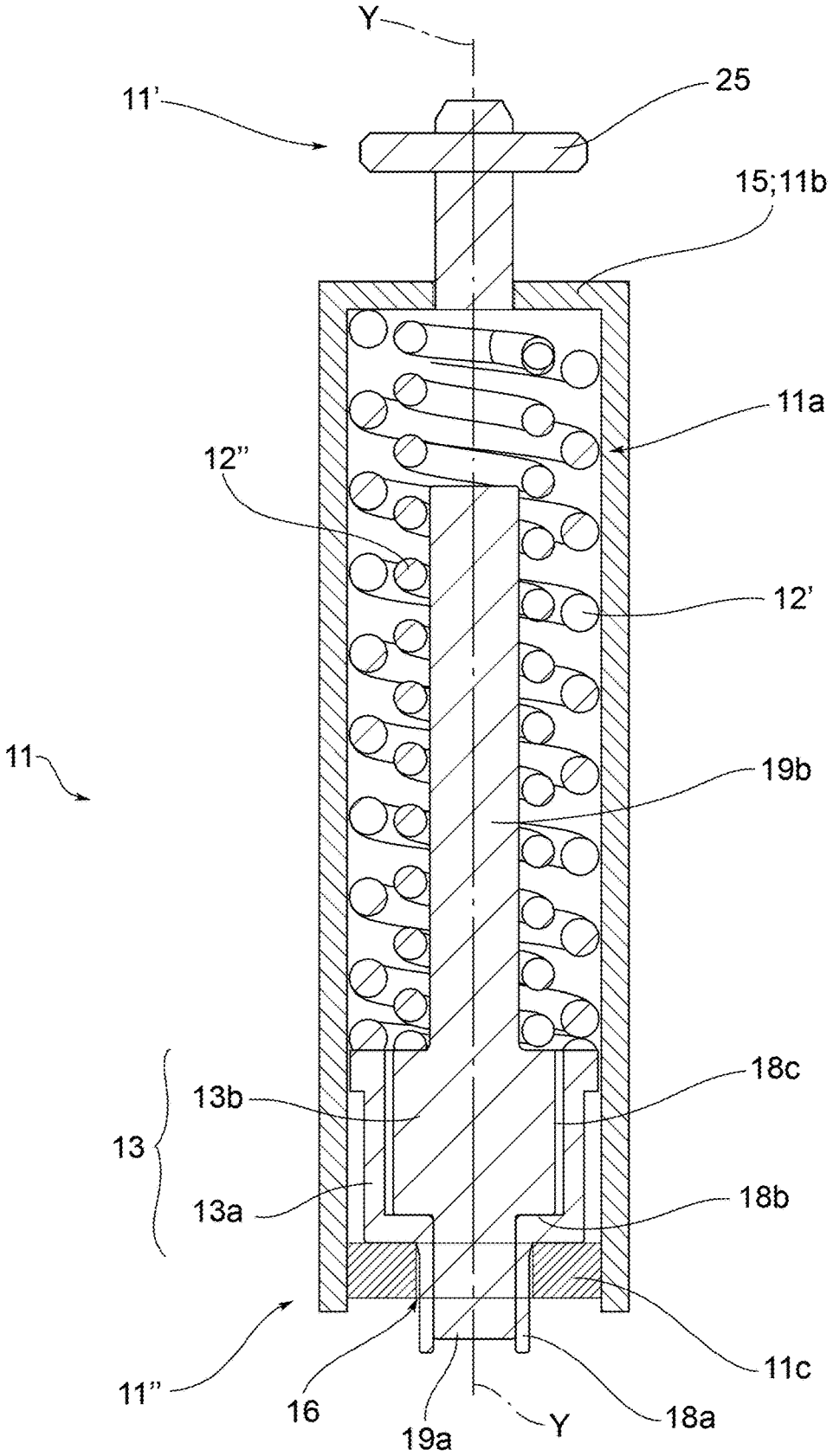
FIGS. 20 and 21 show two axial sectional views of an axial load device in two alternative embodiments to the one illustrated in FIG. 11*a*.
Figure 21:
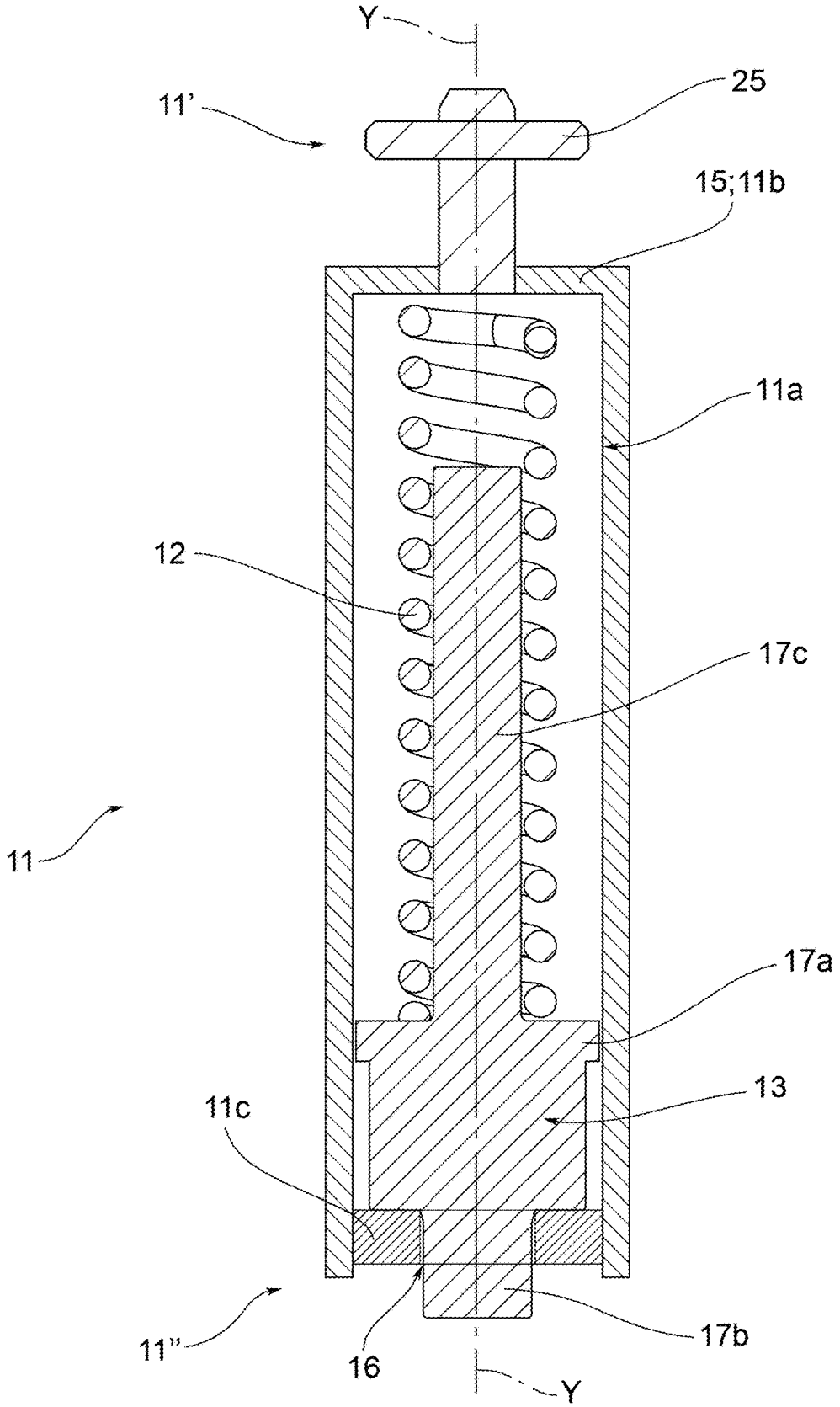

In accordance with a second embodiment of the invention, illustrated in FIGS. 20 and 21, the main body of the support structure 11 consists of a cup body 11*a* inside of which is coaxially arranged the aforesaid at least one compression spring 12', 12". The first axial positioning portion 11*b* consists of the bottom 15 of this cup body, while the second axial positioning portion consists of a closure element 11*c*, which is associated with the cup body 11*a* in a position spaced axially away from the bottom 15. This closure element has an axial through opening 16 to allow access to the inside of the cup body and to the spring 12', 12" arranged therein. In particular, this closure element may consist of an axially bored annular ring nut.

In accordance with the aforesaid second embodiment of the invention, the device 10 may comprise a single compression spring or two (or more) compression springs, which are both axially pre-loaded and are inserted one inside the other coaxially with each other. In the case of two (or more) springs, the device may generate two (or more) different, pre-defined axial loads.

In the case (shown in FIG. 21) wherein the device 10 comprises single axially pre-loaded compression spring 12, preferably the movable abutment body consists of a shaped body 13 comprising an annular abutment portion 17*a* for this single spring 12 and a first axial appendage 17*b* extending outwards from the cup body 11*a* through the aforesaid axial through opening 16. Preferably the shaped body 13 comprises a second axial appendage 17*c* which coaxially supports the single spring 12.

In the case (shown in FIG. 20) wherein the device 10 comprises two (or more) compression springs 12', 12", both axially pre-loaded and coaxially inserted into each other, the aforesaid movable abutment body 13 comprises a first shaped element 13*a* and a second shaped element 13*b*.

More specifically, the first, shaped element 13*a* is interposed between the outer spring 12' and the closure element 11*c* and extends with a neck 18*a* through the axial opening 16 of the closure element 11*c*. The second shaped element 13*b* is interposed between the inner spring 12" and a shoulder 18*b* obtained on the first shaped element 13*a* at an axial through seat 18*c* that crosses the first shaped element 13*a* and within which the second shaped element 13*b* is at least partially, inserted. The latter extends with a first axial appendage 19*a* within the neck 18*a*.

Operationally, the inner spring 12" may be engaged from the outside by means of the first axial appendage 19*a* or the aforesaid second shaped element 13*b* independently of the outer spring 12'. The outer spring 12", on the other hand, may only be used together with the inner spring 12'.

Preferably, the aforesaid second shaped element 13*b* has a second axial appendage 19*b* that coaxially supports the inner spring 12".

Figure 9:
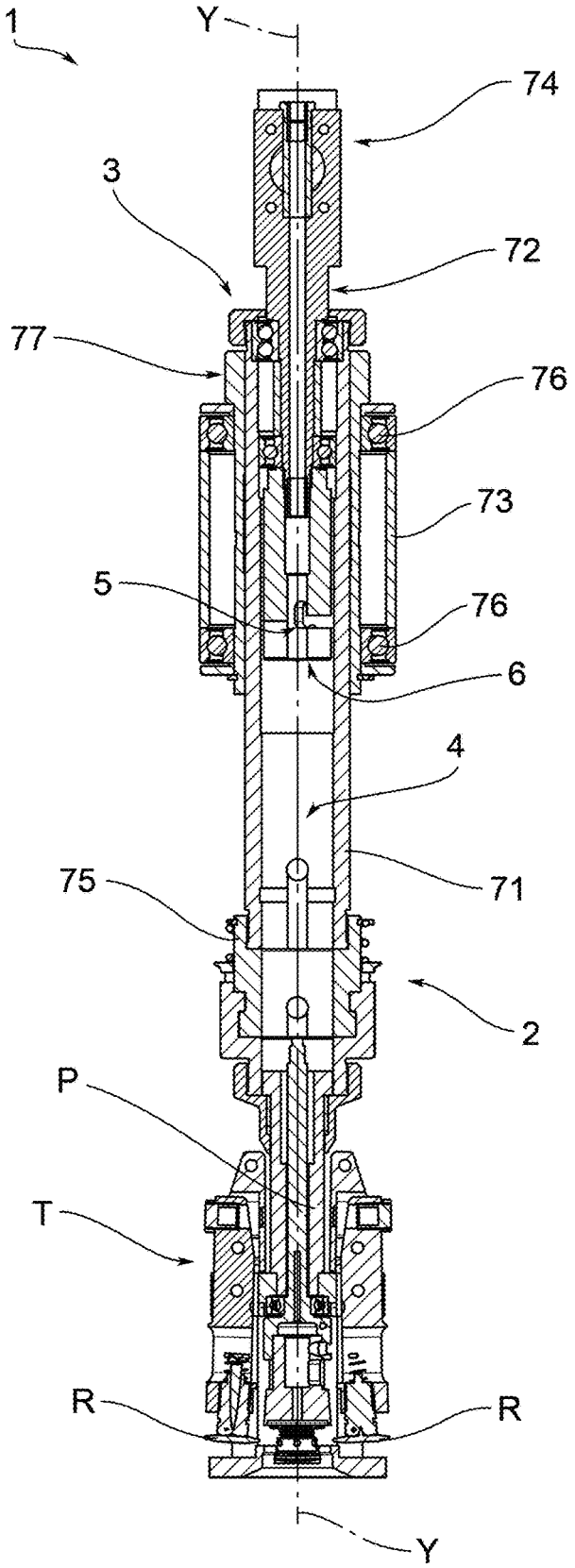
FIG. 9 shows a sectional view of the group in FIG. 6 according to the sectional plane VII-VII shown therein, illustrated without the axial load device.
Figure 10:
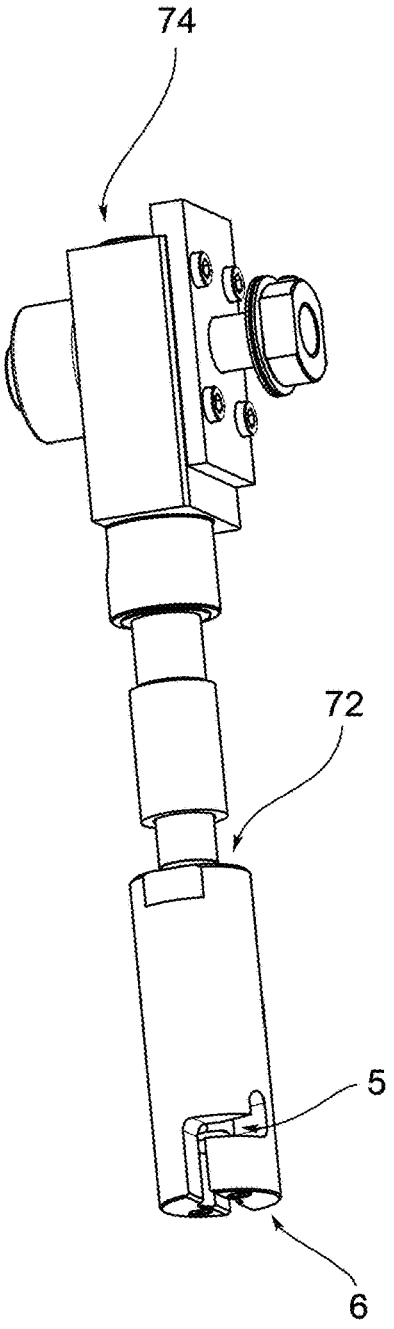
FIG. 10 shows an enlarged perspective view of a component of the transmission group of FIGS. 6-8, suitable to support the axial load device axially.
Figure 12B:
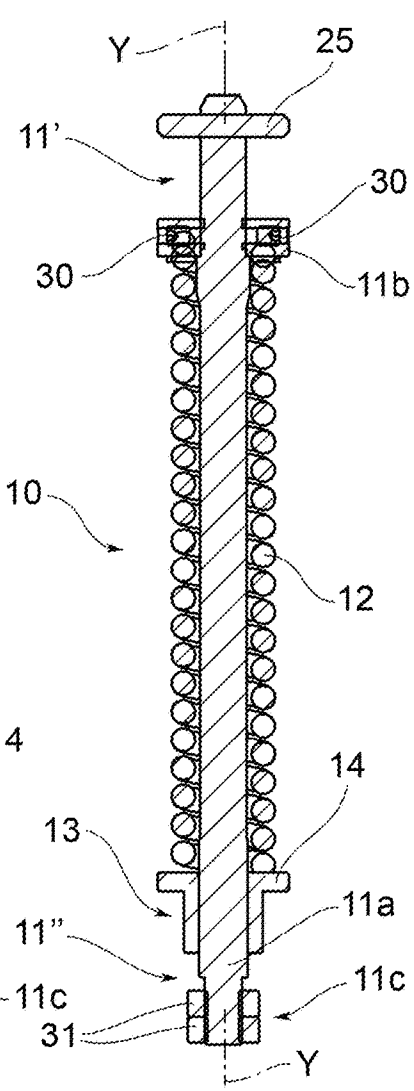
FIG. 12*b* shows an axial sectional view of the axial load device in FIG. 12*a;*
Figure 12A:
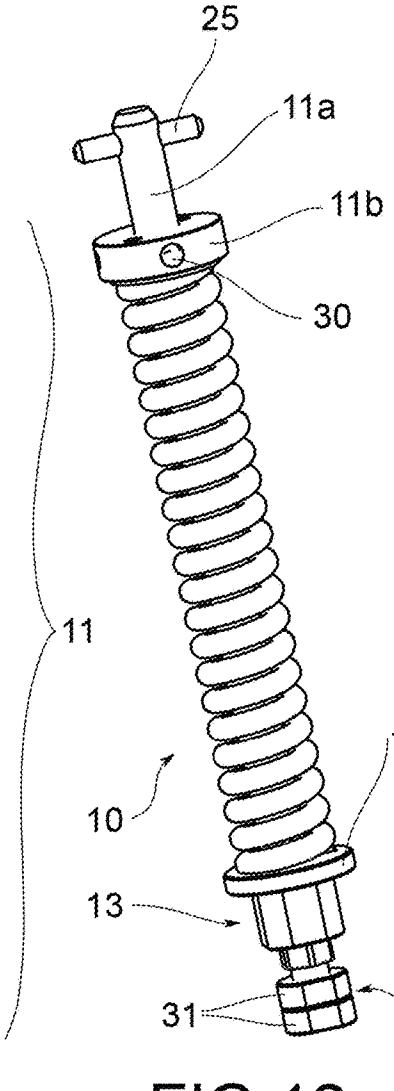
FIG. 12*a* shows a perspective view of the axial load device in FIG. 11*a*, shown in the active condition.
Figure 11B:
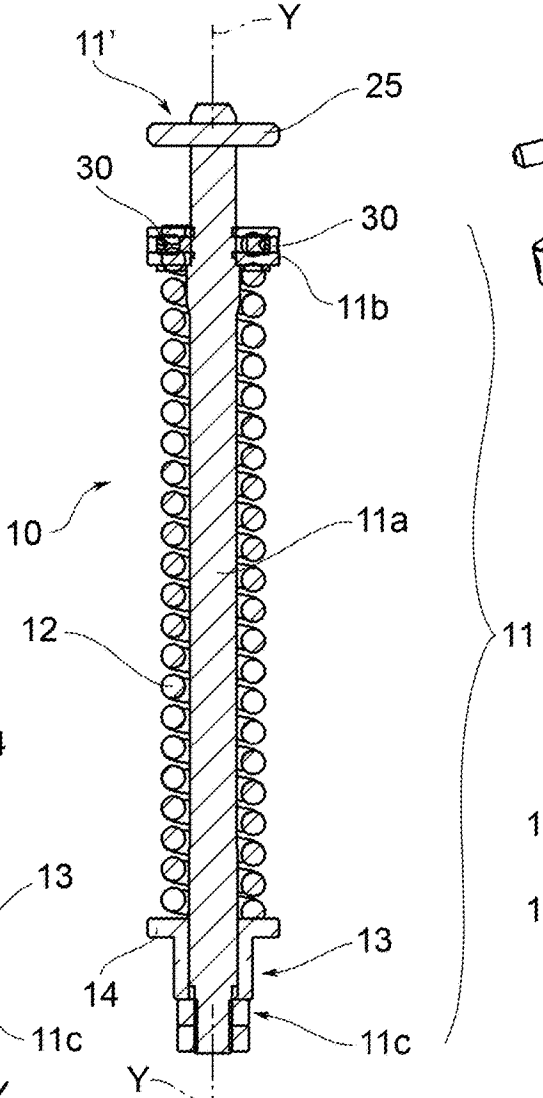
FIG. 11*b* shows an axial sectional view of the axial load device in FIG. 11*a;*
Figure 11A:
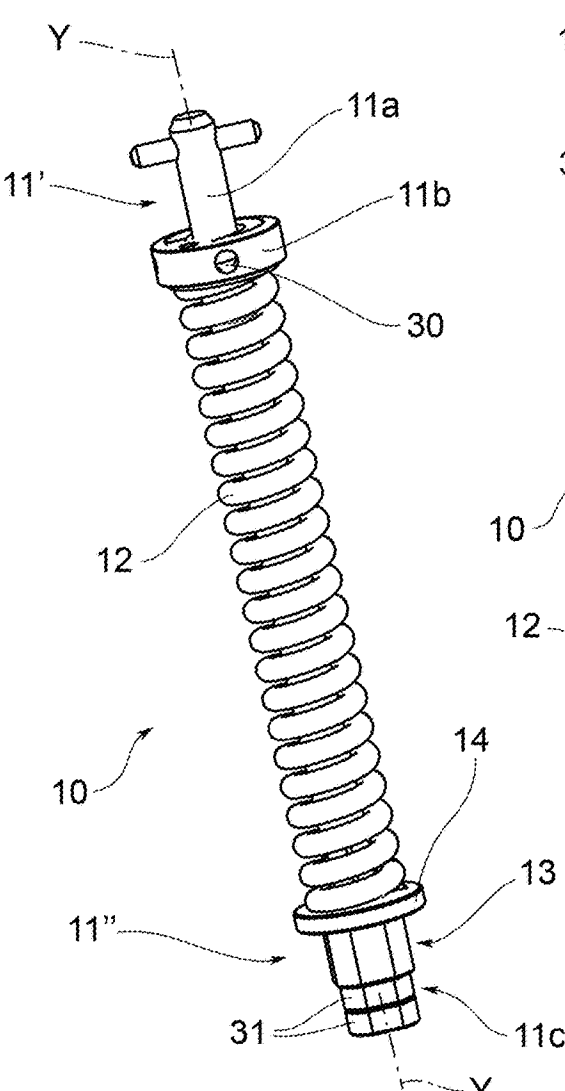
FIG. 11*a* shows an enlarged perspective view of the axial load device of the transmission group of FIGS. 6-8, shown at rest.
Figure 13:
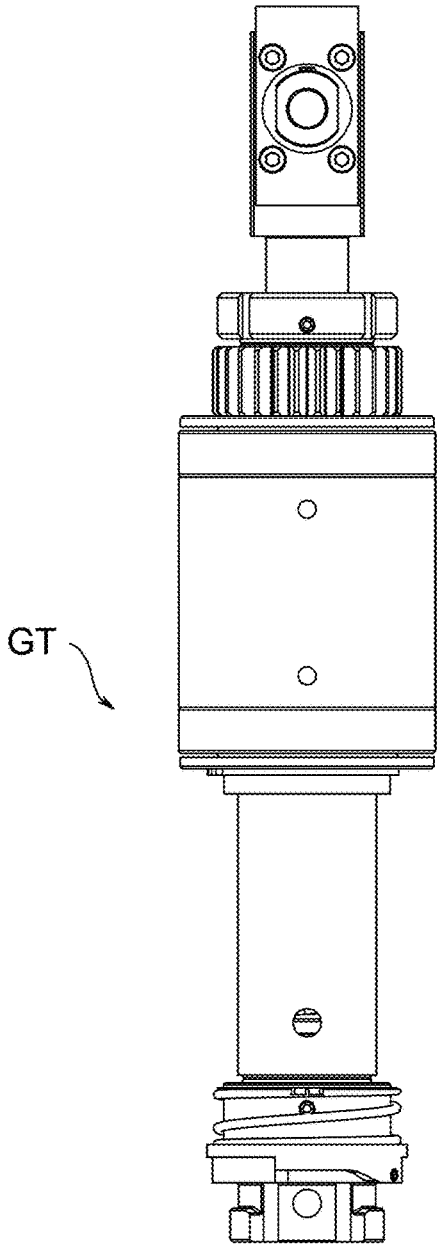
FIG. 13 shows an orthogonal view in elevation of the traditional motion transmission group of FIG. 1, illustrated without the associated capping head.

Advantageously, as illustrated in particular in FIGS. 9 and 16, the main structure 7 of the transmission group 1 delimits an inner chamber 4 extending along the longitudinal axis Y between the coupling end 2 and the drive end 3 and within which the aforesaid axial load device 10 is at least partially inserted.

More specifically, the aforesaid inner chamber 4 is axially open at the coupling end 2 of said group 1 to allow the extraction and insertion of the device 10 in and from the group 1 and to allow the device 10 to engage operationally with the engagement means P of the caps which a capping head T associated in use with the coupling end 2 of the group 1 is provided with.

Figure 7:
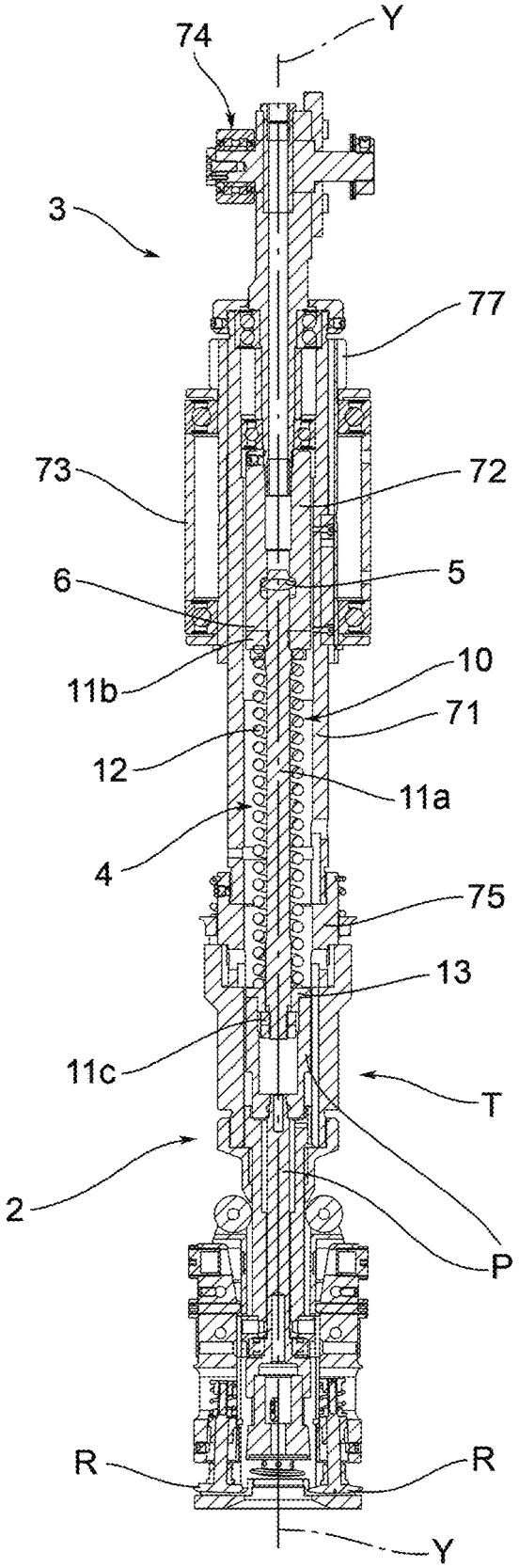
FIG. 7 shows an axial sectional view of the group in FIG. 6 according to the sectional plane VII-VII shown therein.
Figure 8:
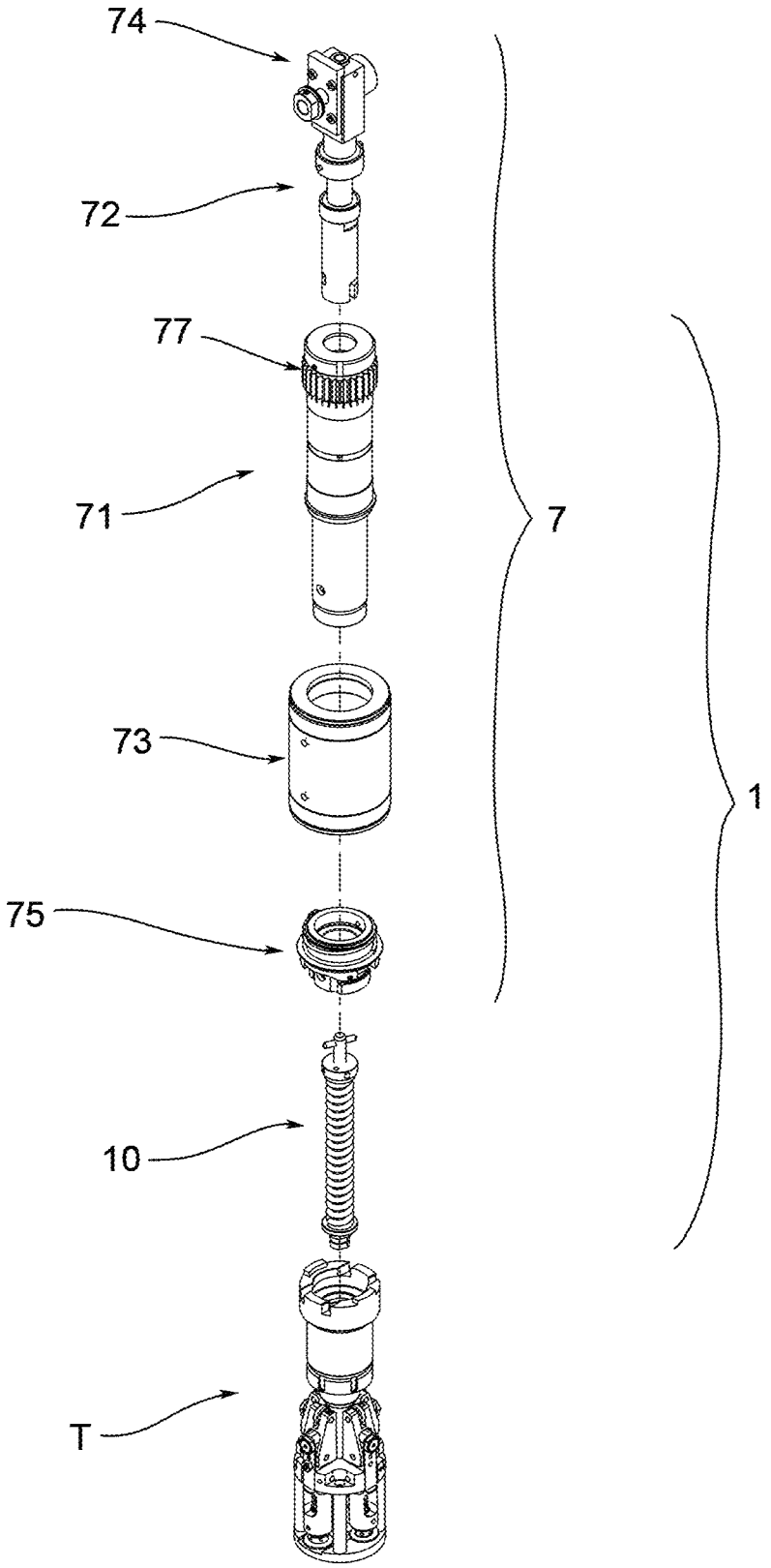
FIG. 8 shows an exploded view of the motion transmission group in FIG. 6.

Advantageously, as illustrated in particular in FIGS. 7 and 16, the aforesaid inner chamber 4 is axially closed near the drive end 3 by a bottom 6. The aforesaid reversible connection means 5, 25 are obtained at the bottom 6 and at the first axial end 11' of the support structure 11 of the device 10.

In particular, in the preferred case wherein the aforesaid reversible connection means 5, 25 are of the quick coupling/ release, bayonet type, the bottom 6 of the inner chamber 4 comprises a shaped coupling seat 5, while the support structure 11 of the device 10 comprises at the first axial end 11' a coupling appendage 25, which may be coupled with a roto-translational insertion movement to the bottom 6 at said shaped coupling seat 5.

In accordance with the embodiments shown in the accompanying Figures, the main structure 7 of the motion transmission group 1 comprises:

- a tubular body 71 extending along the longitudinal axis Y between the coupling end 2 and the drive end 3 and laterally defining the aforesaid inner chamber 4; and
- an elongated body 72, which is partially inserted inside the tubular body 71 axially in order to protrude therefrom at the drive end 3 of the group 1 and defines the bottom. 6 of the inner chamber 4.

Advantageously, the transmission group 1 may be equipped with a quick coupling/release element 75 for a capping head T. In particular, this quick coupling/release element 75 is associated with the aforesaid tubular body 71.

Preferably, the aforesaid elongated body 72 is rotationally decoupled from the tubular body 71. The tubular body 71 is configured to receive in input from a capping machine 100 rotation movements around the longitudinal axis Y, while the elongated body 72 is configured to receive in input from a capping machine 100 translation movements along the longitudinal axis Y.

With the configuration described above, the main structure 7 of the group 1 also comprises a support body 73, which is intended to be fixed to a capping machine 100 and which axially supports the tubular body 71 by means of rotational decoupling 76 around the axis Y.

According to the embodiment illustrated in particular in FIGS. 4 and 5, the transmission group 1 comprises:

- a cam follower 74 which is associated with the elongated body 72 and is intended to engage a cam 101 which is arranged on the capping machine 100 and is shaped to impose on the follower 74 (and the associated elongated body 71) a predefined sequence of translations along the axis Y; and
- a toothed annular portion 77 that is coaxially associated with the tubular body 71 and is suitable to mesh with a mechanism 102 of a capping machine 100 to receive the rotating movement therefrom.

Operationally, the elongated body 72 is rotationally decoupled from the tubular body 71 so as not to rotate the cam follower 74.

Figures 17, 18, 19:
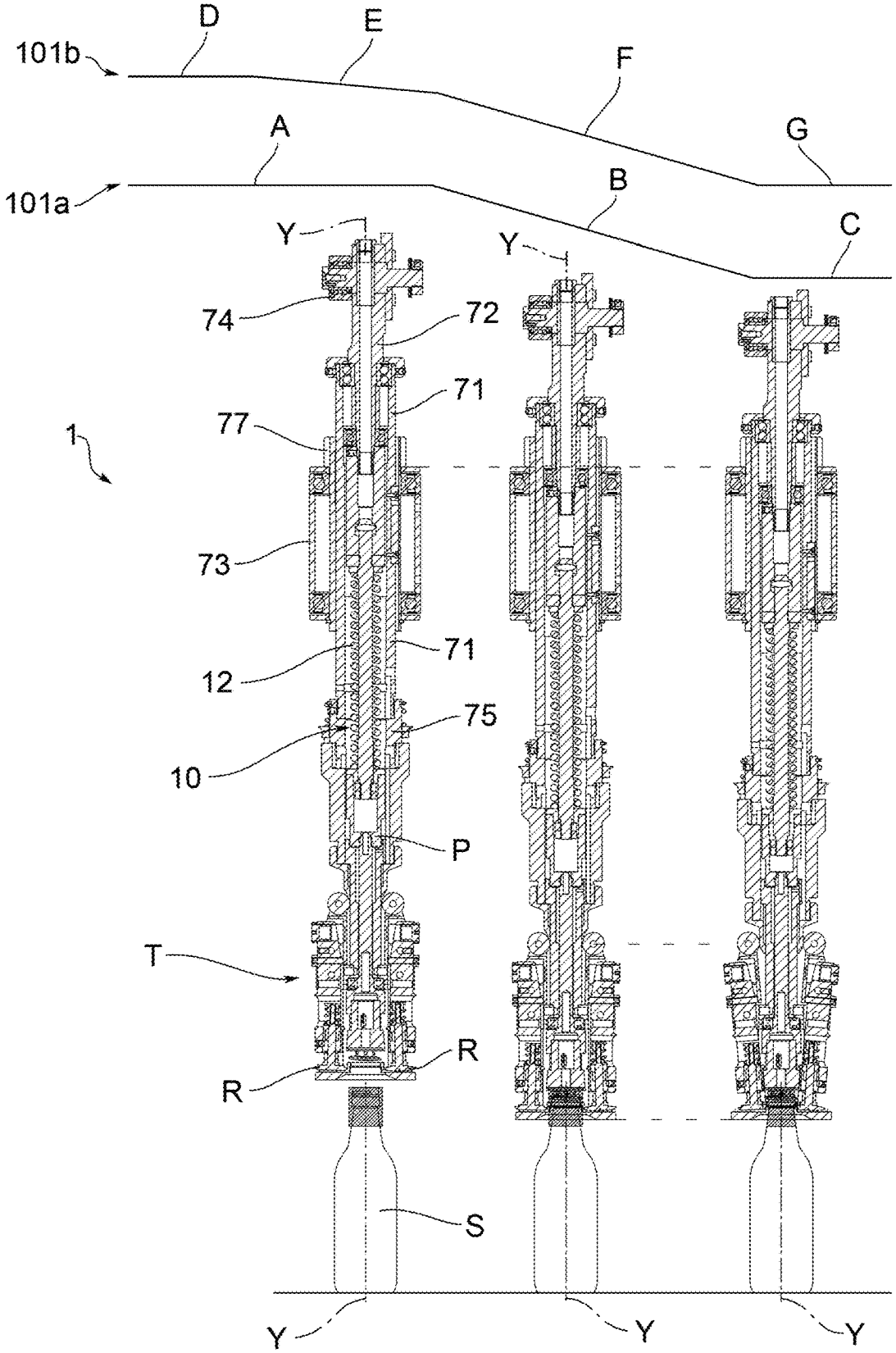
FIGS. 17, 18 and 19 show, with three different axial sectional views, the operating sequence of the motion transmission group in FIG. 6 of an associated capping head.

FIGS. 17, 18 and 19 illustrate the operating sequence of a motion transmission group 1 according to the invention and of an associated capping head T, in terms of translation movements along the axis Y. Above in the Figures the profile of two different cams 101*a* and 101*b* is represented.

More specifically, the profile 101*a* refers to the profile of a cam for a capping head for ROPP caps. In the profile segment indicated at A, the group 1 and the associated head T are in the resting phase; in the segment B, the action of the compression spring and the descent towards the cap Q of the bottle S begins with the relative increase of the applied axial load (vertical); in the segment C, the vertical descent is completed, the head T (by means of the device 10 and the relative spring) is applying the pre-defined axial load and also carries out the threading and the formation of the sealing ring.

The profile 101*b* refers to the profile of a cam for a capping head for pre-threaded caps for beading. In the profile segment indicated at D, the group 1 and the the associated head T are in resting phase; in the segment E, the cap Q is screwed onto the neck of the bottle; in the segment F, the action of the compression spring and the descent towards the cap Q of the bottle S begin with the relative increase of the applied axial load (vertical); in the segment C, the vertical descent is completed, the head T (by means of the device 10 and the relative spring) is applying the pre-defined axial load on the cap Q and also carries out the formation of the sealing ring.

In accordance with an embodiment not illustrated in the accompanying Figures, the transmission group may be configured to receive in input the rotation movements around the longitudinal axis Y and the translation movements along the longitudinal axis Y from a single actuator, which may consist, for example, of a linear rotary motor and is associated with the capping machine. In this case, the capping machine is equipped with an actuator for each transmission group. The actuator also serves as a support element for the transmission group. In this case, neither a cam nor a mechanism for transmitting the rotary motion of the capping machine is provided.

Also subject-matter of the present invention is an axial load device 10 for a motion transmission group 1 according to the invention, and in particular as described above. The axial load device 10 according to the invention, being separable from the transmission group, may in effect be manufactured and sold separately from group 1 as an interchangeable component thereof.

Also subject-matter of the present invention is a capping machine 100 comprising one or more motion transmission groups for capping heads for screw caps. According to the invention, at least one of such motion transmission groups is a motion transmission group 1 according to the invention.

Preferably, as shown in FIGS. 3-5, the capping machine 100 is a rotary-type, multiple capping machine.

Alternatively, the capping machine may be a single capping machine.

The invention allows many advantages already partly described to be obtained.

The motion transmission group for capping heads for screw caps according to the invention is equipped with an integrated axial load device, which allows the axial load to be adjusted quickly and reliably, without requiring the intervention of specialized personnel.

Operationally, unlike traditional solutions of the prior art, due to the transmission group 1 according to the invention, to change the axial load applied to the caps, the compression spring of the axial load device may be replaced without separating it from the other components of the same device, and therefore without requiring operations of controlled unloading of the pre-load forces. The spring is in effect replaced together with the entire axial load device and replaced with another spring, already inserted and properly pre-loaded in another axial load device, interchangeable with the first.

This greatly simplifies the operations of replacing a spring, both during the disassembly of the spring to be replaced, and during the assembly of the new spring, avoiding the intervention of specialized personnel and the use of instrumentation dedicated to the purpose.

Advantageously, according to the different screw caps to be applied, the user may in effect preventively obtain a set of axial load devices, each prepared in advance to generate in use a pre-defined axial load that is specific for a type of cap according to the manufacturer's instructions.

The motion transmission group 1 according to the invention is also simple and economical to construct, since the associated axial load device (separable from the group itself and replaceable with interchangeable devices) consists of constructively non-complex elements. The cost of the transmission group 1 according to the invention is therefore comparable to that of a similar traditional transmission group.

The motion transmission group 1 according to the invention lastly simple and economical to manage, since the operation thereof in a capping machine does not differ from similar traditional transmission groups, except for the adjustment of the axial load applied.

The motion transmission group 1 according to the invention significantly increases the operational flexibility of a capping machine, without requiring changes in the operating cycle. The transmission group 1 is therefore easily suitable also for retrofitting operations of capping machines equipped with traditional transmission groups.

The invention thus conceived therefore achieves the foregoing objects.

Obviously, in its practical implementation, it may also be assumed to take on embodiments and configurations other than those illustrated above without departing from the present scope of protection.

Moreover, all the details may be replaced by technically equivalent elements, and the dimensions, shapes and materials used may be of any kind according to the needs.

The invention claimed is:

1. Motion transmission group for capping heads for screw caps, wherein said capping heads are provided with means for axially engaging the caps, wherein said group is intended to be operatively associated with a capping machine and comprises a main structure extending along a longitudinal axis between a coupling end for a capping head and a drive end, axially opposite to the coupling end, at which the group is configured to receive in input from a capping machine translation movements along said axis and rotation movements around said axis to be transmitted in use to said capping head, wherein said group comprises a device for applying in use a predefined axial load to the axial engagement means of the caps, which a capping head associated in use to said coupling end is provided with, wherein said device in turn comprises at least one axially pre-loaded compression spring so as to generate in use said predefined axial load, wherein said device comprises a support structure for said at least one compression spring, said support structure being suitable to keep said compression spring arranged coaxially to said axis in a predefined pre-loading condition by means of a first and a second axial positioning portion, associated with a main body of said support structure in axially different positions, wherein said support structure is shaped in such a way that said at least one compression spring is engageable directly or indirectly from the outside of said support structure to allow in use the operational coupling with the axial engagement means of the caps, which a capping head associated in use to said coupling end is provided with, and wherein said device is separable by reversible connection means from the main structure of said transmission group as a single body, wherein said device is separably associable with the main structure of said transmission group at a first axial end of said support structure not engaged by said spring by means of said reversible connection means and wherein said support structure is shaped so that at least one compression spring is directly or indirectly engageable from the outside of said support structure at a second axial end of said support structure which is opposite the first axial end and in use is arranged near the coupling end of said transmission group, wherein said device comprises a movable abutment body which is axially slidingly associated with said support structure and is interposed between one end of said spring and the second axial positioning portion, wherein said second axial positioning portion is positioned near said second axial end of said support structure, said movable abutment body facing externally to said support structure near said second axial end, in use said spring being intended to exert said predefined axial load on the axial engagement means of the caps via said movable abutment body, with said at least one spring kept associated to said main body of said support structure in a pre-loaded condition by said two axial positioning portions, to allow the replacement of said device with a structurally similar device, but suitable to generate a different axial load in use.

2. Group according to claim 1, wherein at least one of said two axial positioning portions is axially adjustable relative to the main body of the support structure to adjust the pre-loading of said compression spring.

3. Group according to claim 1, wherein:

the main body of said support structure consists of a bar extending along said axis between said first and said second axial end and coaxially supports said at least one compression spring; and the first and the second axial positioning portion respectively consist of a first and a second fixed annular body, which are arranged in axially different positions along said bar to hold between them said at least one spring in pre-loaded condition.

4. Group according to claim 3, wherein the device comprises a single axially pre-loaded compression spring.

5. Group according to claim 1, wherein:

the main body of said support structure consists of a bar extending along said axis between said first and said second axial end and coaxially supports said at least one compression spring; and the first and the second axial positioning portion respectively consist of a first and a second fixed annular body, which are arranged in axially different positions along said bar to hold between them said at least one spring in pre-loaded condition, and wherein said movable abutment body consists of a movable annular body, slidingly associated with said bar and interposed between one end of said spring and the second fixed annular body.

6. Group according to claim 5, wherein said movable annular body defines an annular protrusion protruding radially with respect to said second fixed annular body.

7. Group according to claim 1, wherein:

the main body of said support structure consists of a cup body inside of which said at least one compression spring is coaxially arranged;

the first axial positioning portion consists of the bottom of said cup body; and the second axial positioning portion consists of a closure element which is associated with the cup body in an axially spaced position with respect to the bottom and has an axial through opening to allow access to the inside of said cup body and to the spring arranged therein.

8. Group according to claim 1, wherein:

the main body of said support structure consists of a cup body inside of which said at least one compression spring is coaxially arranged;

the first axial positioning portion consists of the bottom of said cup body; and the second axial positioning portion consists of a closure element which is associated with the cup body in an axially spaced position with respect to the bottom and has an axial through opening to allow access to the inside of said cup body and to the spring arranged therein and wherein the device comprises a single axially pre-loaded compression spring and wherein said movable abutment body consists of a shaped body comprising an annular abutment portion for said single spring and a first axial appendage extending outward of the cup body through said axial through opening.

9. Group according to claim 8, wherein said shaped body comprises a second axial appendage coaxially supporting said single spring.

10. Group according to claim 1, wherein:

the main body of said support structure consists of a cup body inside of which said at least one compression spring is coaxially arranged;

the first axial positioning portion consists of the bottom of said cup body; and the second axial positioning portion consists of a closure element which is associated with the cup body in an axially spaced position with respect to the bottom and has an axial through opening to allow access to the inside of said cup body and to the spring arranged therein, wherein the device comprises at least two compression springs, both of which are axially pre-loaded and are inserted into one another coaxially and wherein said movable abutment body comprises a first and a second shaped element, wherein the first shaped element is interposed between the outer spring and the closure element and extends with a neck through the axial opening of the closure element and wherein the second shaped element is interposed between the inner spring and a shoulder made on the first shaped element at an axial through seat that crosses said first shaped element and inside of which said second shaped element is at least partially inserted, said second shaped element extending with a first axial appendage inside of said neck, said inner spring being engageable from the outside via the axial appendage of said second shaped element independently of the outer spring.

11. Group according to claim 10, wherein said second shaped element has a second axial appendage that coaxially supports the inner spring.

12. Group according to claim 1, wherein the main structure of said group delimits an inner chamber extending along the longitudinal axis between the coupling end and the drive end and inside which said device is at least partially inserted, wherein said inner chamber is axially open at said coupling end to allow the extraction and insertion of said device into and out of said group and to allow said device to engage operatively with the axial engagement means of the caps, which a capping head associated in use with said coupling end is provided with.

13. Group according to claim 1, wherein the main structure of said group delimits an inner chamber extending along the longitudinal axis between the coupling end and the drive end and inside which said device is at least partially inserted, wherein said inner chamber is axially open at said coupling end to allow the extraction and insertion of said device into and out of said group and to allow said device to engage operatively with the axial engagement means of the caps, which a capping head associated in use with said coupling end is provided with and wherein said inner chamber is axially closed near said drive end by a bottom and wherein said reversible connection means are made on said bottom and at the first axial end of the support structure of said device.

14. Group according to claim 1, wherein said main structure comprises:

a tubular body extending along the longitudinal axis between the coupling end and the drive end and laterally defining an inner chamber an elongated body, which is partially inserted inside said tubular body axially in order to protrude therefrom at the drive end of said group and defines the bottom of said inner chamber.

15. Group according to claim 14, wherein said elongated body is rotationally decoupled from the tubular body and wherein the tubular body is configured to receive in input from a capping machine rotation movements about said longitudinal axis and the elongated body is configured to receive in input from a capping machine translation movements along said longitudinal axis, said main structure comprising a support body, which is intended to be fixed to a capping machine and which axially supports the tubular body by means of rotational decoupling means about said axis.

16. Group according to claim 15, comprising:

a cam follower that is associated with said elongated body and is intended to engage a cam arranged on said capping machine; and a toothed annular portion that is coaxially associated with said tubular body and is suitable to mesh with a mechanism of a capping machine.

17. Axial load device for a motion transmission group according to claim 1.

18. A capping machine comprising one or more motion transmission groups for capping heads for screw caps, wherein at least one of said motion transmission groups is a motion transmission group according to claim 1.

19. The capping machine of claim 18 wherein said capping machine is a multiple rotary capping machine.

* * * * *